US005197548A

United States Patent [19]

Volker et al.

[11] Patent Number: 5,197,548

[45] Date of Patent: Mar. 30, 1993

[54] FIRE EXTINGUISHING DEVICE WITH STORAGE TANK FOR A LOW-BOILING LIQUEFIED GAS WHICH SERVES AS EXTINGUISHING AGENT

[75] Inventors: Wolfgang Volker, Tonisvorst; Karl F. Striewisch, Essen, both of Fed. Rep. of Germany

[73] Assignee: Messer Griesheim GmbH, Frankfurt, Fed. Rep. of Germany

[21] Appl. No.: 823,712

[22] Filed: Jan. 21, 1992

[30] Foreign Application Priority Data

Jan. 22, 1991 [DE] Fed. Rep. of Germany ..... 4101668

[51] Int. Cl.[5] ..... A62C 35/13

[52] U.S. Cl. ..... 169/11; 169/70

[58] Field of Search ..... 169/11, 70; 62/47.1

[56] References Cited

U.S. PATENT DOCUMENTS 2,525,570 10/1950 Williamson ..... 169/11 X
2,978,187 4/1961 Hesson ..... 169/11 X
3,782,474 1/1974 Wiseman, Jr. ..... 169/11 X
3,830,307 8/1974 Bragg et al. ..... 169/11 X

FOREIGN PATENT DOCUMENTS 1333344 8/1987 U.S.S.R. ..... 169/11
1512629 10/1989 U.S.S.R. ..... 169/11

*Primary Examiner*—Russell D. Stormer
*Assistant Examiner*—James M. Kannofsky
*Attorney, Agent, or Firm*—Connolly & Hutz

[57] ABSTRACT

A fire extinguishing device has a storage tank for a low-boiling liquefied gas which serves as the extinguishing agent. At least one connection line is equipped with a shut-off valve and an outlet nozzle leading from the storage tank into the area to be protected. A fire monitoring device which actuates the shut-off valve has sensors in the area to be protected. A cryo-compressor is located in the head space of the storage tank connected with an external cooling mechanism.

12 Claims, 2 Drawing Sheets

FIRE EXTINGUISHING DEVICE WITH STORAGE TANK FOR A LOW-BOILING LIQUEFIED GAS WHICH SERVES AS EXTINGUISHING AGENT

BACKGROUND OF INVENTION

Valuable technical systems, for example, electronic systems, are equipped with automatic fire-extinguishing devices, which operate with extinguishing agents from the series of the Halons. These are ideal, highly effective extinguishing agents which, however, will no longer be allowed in the future. As an alternative to the Halons, carbon dioxide and inert low-boiling liquefied gases are available. However, carbon dioxide is not very suitable for valuable technical systems. After fires which have been extinguished with carbon dioxide, corrosion occurs to the metal parts which are sensitive to such damage as a result of the effect of the carbonic acid which is formed from carbon dioxide and water vapor. This is especially disadvantageous for electronic components. After a fire extinguished in time with carbon dioxide, such secondary damage, often with long-term effects, can occur.

So far, nitrogen is the only one of the inert low-boiling liquefied gases that has been used as an extinguishing agent. Thus, for example, U.S. Pat. No. 3,830,307 discloses a fire extinguishing device with liquid nitrogen as the extinguishing agent. Nitrogen as an extinguishing agent has proven its worth in certain individual cases, for example, in mine fires. However, in contrast, nitrogen has turned out not to be very suitable for extinguishing open fires. The reason for this is its relatively low molecular weight of 28, which results in a low density ratio to the air and thus a poor sinking behavior. In this respect, other low-boiling liquefied gases seem to be more suitable. Thus, for example, the molecular weight of argon is 40, thus almost reaching the molecular weight of carbon dioxide, namely, 44. Gaseous argon has almost the same density as gaseous carbon dioxide. The density ratio to air, for example, at 0° C. [32° F.] and 1.013 bar, is 1.38 for argon and 1.53 for carbon dioxide. However, the high price of argon in comparison to nitrogen appears to be a disadvantage. This is especially true of other inert low-boiling liquefied gases. Due to the inevitable heat flow of the low-boiling liquefied gas into the storage tank, expensive evaporation losses occur. Whereas these losses can be tolerated with liquid nitrogen, since it is not very expensive to occasionally refill the storage tank with liquid nitrogen to replace the evaporated nitrogen, this would be a major cost factor in the case of argon.

SUMMARY OF INVENTION

The invention is based on the task of creating a fire extinguishing device with a storage tank for a low-boiling, liquefied gas, especially argon, with which the costs of the storage of the liquefied gas can be kept very low.

Argon is preferred as the extinguishing agent. Since its density is similar to that of carbon dioxide, it has the same favorable extinguishing properties similar to those of carbon dioxide, without having its disadvantages. The pressure of argon in the storage tank is preferably 15 to 40 bar, so that common pressurized tanks can be used. Suitable cooling mechanisms are compression machines having helium as the operating gas, of the type known from cryophysics. In the case of high tank pressures of the argon, however, it is also possible to use other cooling mechanisms, for example, by means of a cryomedium such as liquid nitrogen. In special cases, for example, with large tanks for liquid argon, the cooling can also stem from a separate aggregate located outside of the storage tank, so that it is possible to dispense with the cryocompressor in the head space of the tank.

As a rule, there are several connection lines from the liquid space of the storage tank to different places in the area to be protected or to different areas to be protected. In addition, however, it is also possible to install connection lines from the head space of the storage tank.

In case of fire, the liquid argon, partially vaporizing, flows through the connection lines and emerges as a mixture of liquid and gas through the nozzles located at the end of the connection line. In order to achieve a fast and complete evaporation of the liquid, the outlet surfaces of the outlet nozzles preferably have a sintered metal body. As a result, the liquid is vaporized into extremely fine droplets. However, it is also possible to use multi-hole nozzles which additionally have a countercurrent cooler insert made of sintered metal on the inside.

THE DRAWINGS

DETAILED DESCRIPTION

Figure 1:
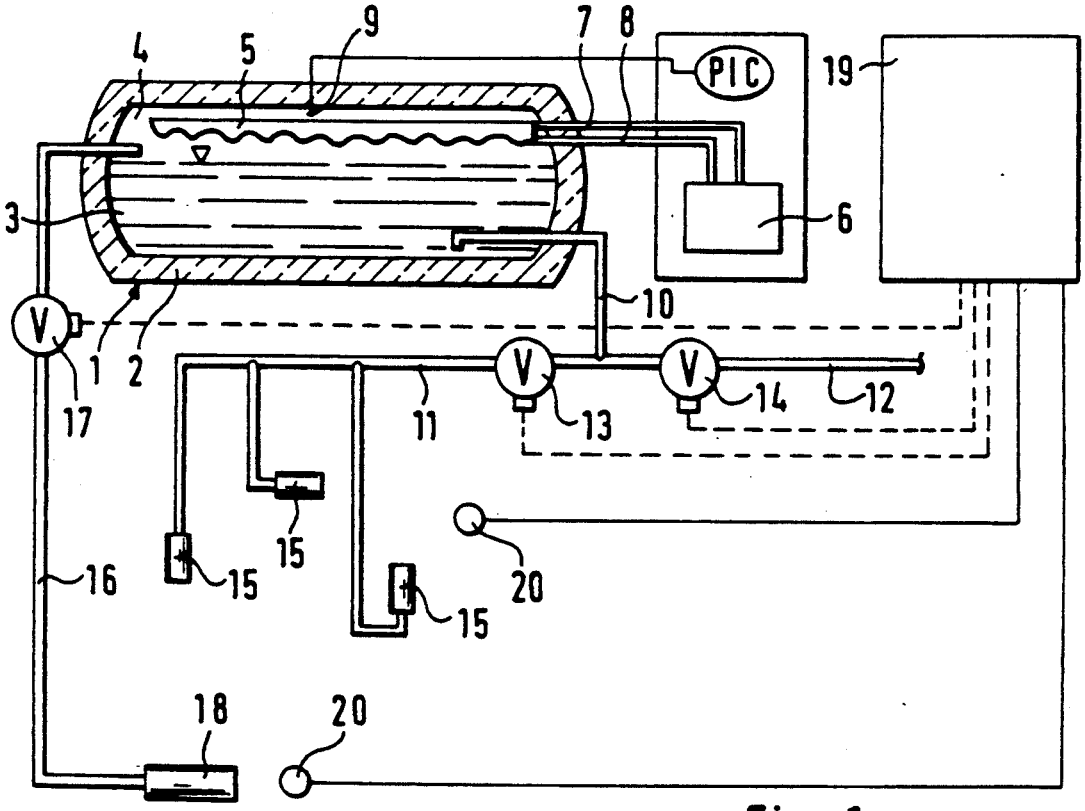
FIG. 1 shows a fire extinguishing device in schematic form, in accordance with this invention.

The fire extinguishing device shown in FIG. 1 has a storage tank 1 which is equipped with an insulation 2. The insulation can be carried out by the powder-vacuum technique or by the multi-layer vacuum technique. The storage tank 1 is designed vertically, so that it can be easily installed in the buildings to be protected. The liquid space 3 of the storage tank 1 is filled with liquid argon, whereas there is cold gaseous argon in the head space 4.

According to the invention, there is a cryo-compressor 5 in the head space 4 and this cryo-compressor 5 serves to maintain the desired equilibrium conditions in the storage tank. For this purpose, a compression machine serves as the external cooling mechanism 6 with helium as the operating gas, which is connected to the cryo-compressor 5 via lines 7 and 8. The regulating variable for the operation of the cooling mechanism 6 is the temperature in the head space 4, which is picked up by the temperature sensor 9. The liquid argon is stored in the storage tank 1 under equilibrium conditions. At a storage pressure of, for example, 15 bar, the equilibrium temperature is 124° K., and this temperature is maintained by means of the cryo-compressor 5 and of the external cooling mechanism 6. If the storage tank 1 is equipped with a high-quality insulation 2, then the required cooling power capacity of the cooling mechanism 6 is relatively low. The investment costs are correspondingly low. It is also possible to dispense with lines 7 and 8 if the cooling mechanism 6 is installed directly on the storage tank 1.

A connection line 10 protrudes from the liquid space 3 of the storage tank 1 and it turns into the distribution lines 11 and 12. There are automatic shut-off valves 13 and 14 in the distribution lines 11 and 12. The distribution line 11 ends in three outlet nozzles 15, which are located at different places in the area to be protected. Correspondingly, the distribution line 12 leads to another area to be protected (not shown here). In addition, a connection line 16 comes out of the head space 4 of the storage tank 1. It likewise has an automatic shut-off valve 17 and an outlet nozzle 18.

The monitoring is carried out by a fire monitoring device 19 to which sensors 20 are attached, which react to smoke, fire and heat. The fire monitoring device 19 also actuates the automatic shut-off valves 13, 14 and 17. In case of fire, these valves are opened so that liquid argon flows through the connection line 10 to the outlet nozzles 15. In addition, gaseous argon can flow through the connection line 16 to the outlet nozzle 18. However, this is not absolutely necessary, as a rule it is sufficient to withdraw liquid argon as the extinguishing agent through the connection line 10. Of course, the use of gaseous argon from the head space 4 of the storage tank 1 is advantageous when a very gentle application of extinguishing agent is desired.

A mixture of liquid and gaseous argon flows to the outlet nozzles 15. In order to achieve a good extinguishing effect without further fanning the source of fire, it is necessary for the gas flow to be as calm as possible. This is why the outlet nozzles 15 have large cross sections.

Figure 2:
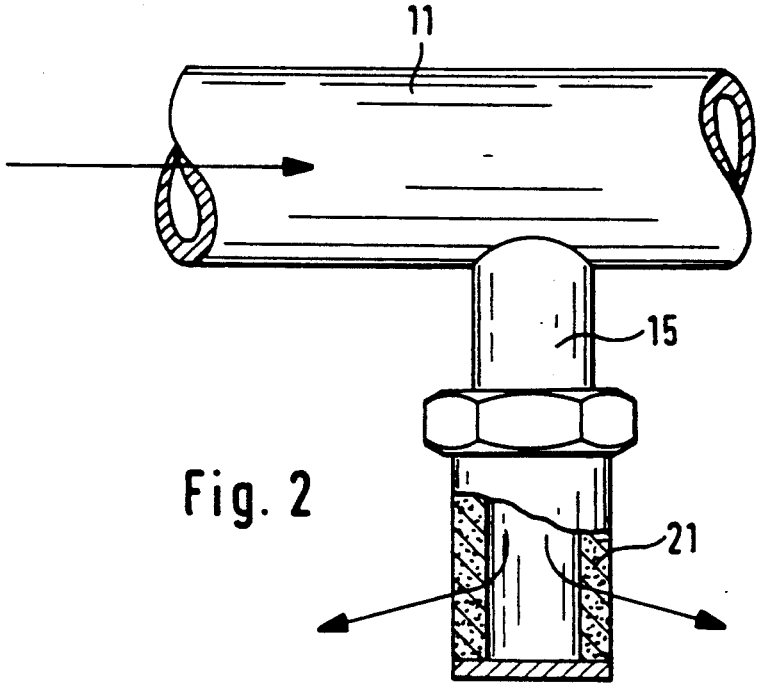
FIG. 2 shows an outlet nozzle with a sintered metal body, in accordance with this invention.
Figure 3:
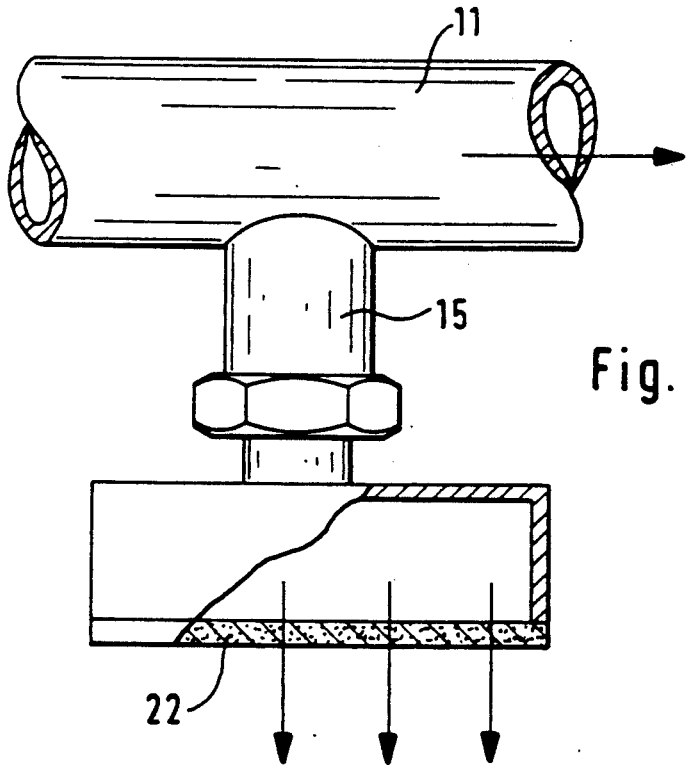
FIG. 3 shows another outlet nozzle with a sintered metal body.

Moreover, the liquid argon must be distributed as finely as possible when it emerges from the outlet nozzles 15. For this purpose, sintered metal bodies are very well suited as outlet surfaces. FIGS. 2 and 3 show two different embodiments of outlet nozzles 15 with sintered metal bodies 21 or 22. The arrows show the flow direction of the extinguishing gas.

Figure 4:
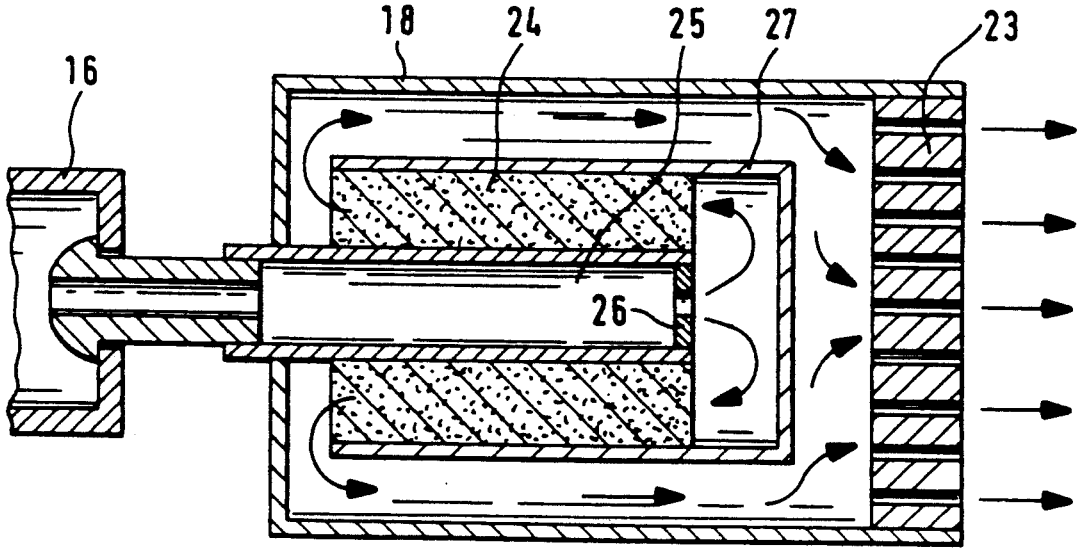
FIG. 4 shows an outlet nozzle designed as a multi-hole nozzle with a countercurrent cooler insert.

FIG. 4 shows an outlet nozzle 18, which is especially well-suited for use with gaseous argon. The outlet surface here is designed as a multi-hole nozzle 23. It allows a virtually laminar outlet flow with a great range (approx. 1 to 2 meters). The gaseous argon flowing out of the connection line 16 and into the outlet nozzle 18 under the tank pressure is relieved there to about 1 bar. The cooling off that occurs during this relief is utilized to cool off the argon flowing out of the multi-hole nozzle 23 as much as possible in order to raise its density. For this purpose, there is a countercurrent cooler insert 24 made of sintered metal. The argon entering through the central pipe 25 is relieved in the diaphragm 26, deflected by the receptacle 27 and led back through the countercurrent cooler insert 24 made of sintered metal along the central pipe 25. In this manner, the central pipe 25 and thus the entering argon gas are precooled.

Of course, the fire extinguishing device according to the invention has the usual monitoring and safety devices such as, for example, devices to measure the filling level and safety valves (not shown here).

SUMMARY OF INVENTION

Fire extinguishing devices can be operated with liquid nitrogen as the extinguishing agent. However, nitrogen has turned out to be less suitable for extinguishing open fires since it has poor sinking behavior due to its relatively low molecular weight. Other low-boiling liquefied gases which are more suitable in this respect, especially argon, are felt to be too expensive, because considerable evaporation losses can be expected as a result of the inevitable heat flow into the storage tank. In order to avoid these disadvantages, a cryo-compressor (5) is located in the head space (4) of the storage tank (1), which is connected to an external cooling mechanism (6). (FIG. 1)

What is claimed is:

1. In a fire extinguishing device with a storage tank for a low-boiling liquefied gas which serves as an extinguishing agent, at least one connection line equipped with shut-off valves and outlet nozzles leading from the storage tank into the area to be protected, and a fire monitoring device which actuates the shut-off valves and which has sensors in an area to be protected, the improvement being said storage tank having a head space and a liquid space, a cryo-compressor being located in said head space of said storage tank, said cryo-compressor being connected with an external cooling mechanism, and said extinguishing agent in said storage tank being argon.

2. Fire extinguishing device according to claim 1, characterized in that said external cooling mechanism is a compression machine having helium as an operating gas.

3. Fire extinguishing device according to claim 1, characterized in that said at least one connection line is connected to said liquid space of said storage tank.

4. Fire extinguishing device according to claim 1, characterized in that each of said outlet nozzles is designed as a multi-hole nozzle.

5. Fire extinguishing device according to claim 1, characterized in that the tank pressure of said argon ranges from 15 to 40 bar and its temperature is the appertaining equilibrium temperature.

6. Fire extinguishing device according to claim 5, characterized in that said external cooling mechanism is a compression machine having helium as the operating gas.

7. Fire extinguishing device according to claim 6, characterized in that said at least one connection line is connected to said liquid space of said storage tank.

8. Fire extinguishing device according to claim 7, charactized by at least one additional connection line connected to said head space of said storage tank.

9. Fire extinguishing device according to claim 8, characterized in that each of said outlet nozzles has a sintered metal body as its outlet surface.

10. Fire extinguishing device according to claim 8, characterized in that each of said outlet nozzles is designed as a multi-hole nozzle.

11. Fire extinguishing device according to claim 10, characterized in that each of said multi-hole nozzles has a countercurrent cooler insert made of sintered metal.

12. In a fire extinguishing device with a storage tank for a low-boiling liquefied gas which serves as an extinguishing agent, at least one connection line equipped with shut-off valves and outlet nozzles leading from the storage tank into the area to be protected, and a fire monitoring device which actuates the shut-off valves and which has sensors in an area to be protected, the improvement being said storage tank having a head space, a cryo-compressor being located in said head space of said storage tank, said cryo-compressor being connected with an external cooling mechanism, and each of said outlet nozzles has a sintered metal body as its outlet surface.

* * * * *